United States Patent [19]

Winter

[11] 3,978,570

[45] Sept. 7, 1976

[54] METHOD OF MANUFACTURING A ROTOR FOR VANE TYPE ENGINES

[75] Inventor: Klaus Winter, Schwalbach, Germany

[73] Assignee: ITT Industries, Inc., New York, N.Y.

[22] Filed: Aug. 2, 1974

[21] Appl. No.: 494,332

[30] Foreign Application Priority Data

Aug. 17, 1973 Germany ..... 2341677

[52] U.S. Cl. ..... 29/156.4 R; 29/156.8 R; 418/238; 418/266

[51] Int. Cl.[2] ..... B23P 15/00

[58] Field of Search ..... 29/156.4 R, 156.8 R; 418/266, 267, 238, 122, 123

[56] References Cited

UNITED STATES PATENTS

| | | | |
|---|---|---|---|
| 1,249,806 | 12/1917 | Morris | 418/266 |
| 1,302,930 | 5/1919 | Kochendarfer | 418/266 |
| 2,062,576 | 12/1936 | Johnson | 418/266 |
| 2,623,727 | 12/1952 | McLeod | 29/156.8 R |
| 3,614,276 | 10/1971 | Erdmann | 418/266 |
| 3,626,265 | 12/1971 | Kraakman | 418/266 |
| 3,782,867 | 1/1974 | Gerlach et al. | 418/267 |

FOREIGN PATENTS OR APPLICATIONS

| | | | |
|---|---|---|---|
| 608,438 | 4/1926 | France | 418/266 |
| 628,562 | 11/1961 | Italy | 418/267 |

*Primary Examiner*—C.W. Lanham
*Assistant Examiner*—Dan C. Crane
*Attorney, Agent, or Firm*—James B. Raden; Marvin M. Chaban

[57] ABSTRACT

Disclosed are a rotor and a method for manufacturing a rotor for vane-type engines. The rotor includes radial slots which guide vanes extending from spring chambers within the rotor. In the practice of the method: (a) radial bores are provided in rotors to receive springs and serve as spring chambers, (b) longitudinal bores are formed in the rotors parallel to the rotor axes and intersecting the radial bores, (c) springs are placed in the spring chambers (radial bores) to extend into the longitudinal bores, (d) the radial bores are partially closed on the outside by plastic deformation of the rotor material, and (e) radial slots are formed parallel to the rotor axes to intersect the radial bores and permit vanes to extend therethrough.

3 Claims, 1 Drawing Figure

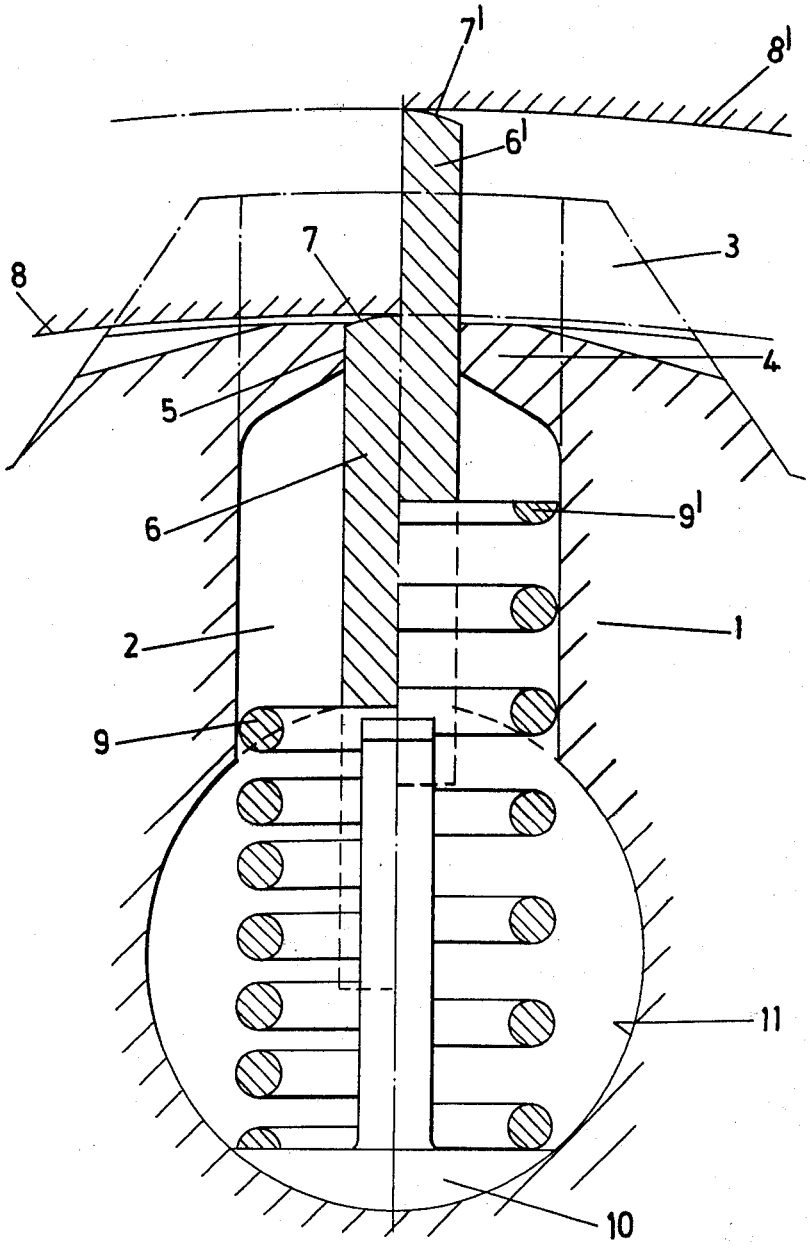
7'
8'
6'
7
3
8
4
5
6
9'
2
1
9
11
10

METHOD OF MANUFACTURING A ROTOR FOR VANE TYPE ENGINES

BACKGROUND OF THE INVENTION

1. Field of the Invention

This invention relates to a rotor and a method of manufacturing a rotor for vane-type engines with radial slots for guiding the vanes. The vanes project into spring chambers provided inside the rotor which contains springs assisting the vanes in extending. The diameter of the springs is chosen to exceed the width of the slots.

2. Description of the Prior Art

In vane-type engines, especially in vane-type motors, a certain pressing force is necessary in order to press the vanes against the stroke turn. At the same time, to minimize the effects of wear, the narrowest possible vanes are desired.

To meet these requirements it is known to arrange pressure springs in longitudinal bores in a rotor in which bores the slots receiving the vanes end. These pressure springs rest against the wall of the longitudinal bore most distant from the vanes, and are supported — under initial stress — at the sections of the vanes projecting to the inside. To obtain a great spring force it is further known to design the springs to be as big as their mounting space, the longitudinal bore, permits. In this prior art method, the mounting of cask-shaped springs has proved to be most favorable. But this method has the disadvantage that such a complicatedly designed casked-shaped spring is expensive, and that only a limited spring stroke is possible due to the spatial confinement by the diameter of the longitudinal bore.

SUMMARY OF THE INVENTION

It is, therefore, an object of this invention to manufacture a rotor for vane-type engines using a simple method. A further object is to provide a rotor which can be cheaply and simply assembled, to permit the mounting of springs producing great pressure forces which are radially directed toward the outside on the vanes.

According to this invention the foregoing objects and objects ancillary thereto are achieved by a. forming a rotor to have radial bores which serve as spring chambers,
b. forming radial slots in the rotor for guiding vanes and holding the vanes in a position running parallel to the rotor axis and intersecting the radial bores,
c. providing longitudinal bores parallel to the rotor axis in which bores the radial bores end, and which form the bottom chambers for the vanes,
d. placing springs in the radial bores,
e. locking the radial bores radially on the outside of the rotor by plastic deformation of selected rotor material at the cylindrical outer surface, and
f. placing vanes in said radial slots.

In the practice of the method it has been found to be desirable to form the rotor with attachments at its cylindrical lateral surface adjacent to the area of the bores forming the spring chambers, the material volume of which attachments, which must be allowed to deform plastically, at least corresponds to the volume required to lock the ends of the bores to prevent springs from being ejected.

An advantage of manufacture of the rotor according to the inventive method, where advantageously narrow vanes are used, include the provision of a larger mounting space for the spring. Owing to the provision for mounting a larger spring in this mounting space, a spring tension which is about twice as great as the spring tension in the comparable vane-type engines, manufactured in accordance with the manufacturing methods common up to now, is obtained on account of the considerably longer spring stroke.

As only a normal pressure spring is required instead of a special cask-shaped spring, this arrangement results in a considerable reduction in cost.

Since enough spring space is now available, it is no longer necessary to dimension the spring to such a small size that the utmost limit of the maximum admissable fatigue strength is reached. Thus, an additional protection against spring fracture is provided.

BRIEF DESCRIPTION OF THE DRAWING

The sole FIGURE of the drawing shows a section of a rotor of a vane-type engine wherein a vane is illustrated in semi-cross-sectional view in retracted and extended positions.

DESCRIPTION OF PREFERRED EMBODIMENTS

A rotor 1 is provided with a radial bore 2, which is blocked by material 4 to form a semi-closed space retaining a spring 9, 9′. This semi-closed space is formed by plastic deformation of the material 3, shown in the FIGURE as a line of semicolons. In a slot 5 a vane 6,6′ is guided. This vane rests against a stroke turn 8,8′ with its end surface 7,7′ projecting to the outside, and is spring biased in these positions by a pressure spring 9,9′ on the opposite side projecting to the inside. This pressure spring 9,9′ is guided in the bore 2 and rests against a ribbed guide in breechblock 10, which is disposed in a longitudinal bore 11 in the rotor. The bore 11 thus forms the bottom chamber for the vanes.

On being mounted, the compressed spring 9,9′ is directed laterally through the longitudinal bore 11 together with the ribbed guide in breechblock 10.

While the principles of the invention have been described above in connection with specific apparatus and applications, it is to be understood that this description is made only by way of example and not as a limitation on the scope of the invention.

What is claimed is:

1. A method for manufacturing a rotor for vane-type engines having radial slots for guiding vanes which project into spring chambers provided inside the rotor and containing springs assisting the vanes in extending into a space where the diameter of the springs is chosen to exceed the width of the slots, comprising the steps of providing radial bores in rotors to serve as spring chambers, closing the bores by plastic deformation of rotor material at the surface of the rotor, providing radial slots which run parallel to the rotor axis to intersect the radial bores, said radial slots being formed in a manner to enable them to serve as guides for vanes and permit movement of the vanes, providing longitudinal bores running parallel to the rotor axis, in which bores the radial bores terminate, and which form the bottom chambers for the vanes, placing springs in said radial bores, and placing vanes in said radial slots.

2. The method as claimed in claim 1, in which the springs are placed in the longitudinal bores and then allowed to extend into the radial bores.

3. A method for manufacturing a rotor for vane-type engines comprising providing a rotor having a substantially cylindrical surface, providing extensions to the cylindrical surface adjacent to radial bores forming spring chambers in the rotor, where the material of said extensions corresponds in volume to that required to partially close the bores, inserting springs within the radial bores, plastically deforming the extensions to complete the spring chambers, and placing vanes within the partially closed bores.

* * * * *